US010471622B2

(12) United States Patent
Volzer et al.

(10) Patent No.: US 10,471,622 B2
(45) Date of Patent: Nov. 12, 2019

(54) CRAYON MANIPULATION DEVICES

(71) Applicant: CRAYOLA, LLC, Easton, PA (US)

(72) Inventors: David Volzer, Easton, PA (US); Anthony Monzo, Easton, PA (US)

(73) Assignee: Crayola LLC, Easton, PA (US)

( * ) Notice: Subject to any disclaimer, the term of this patent is extended or adjusted under 35 U.S.C. 154(b) by 19 days.

(21) Appl. No.: 15/618,916

(22) Filed: Jun. 9, 2017

(65) Prior Publication Data

US 2017/0355093 A1 Dec. 14, 2017

Related U.S. Application Data

(60) Provisional application No. 62/347,974, filed on Jun. 9, 2016.

(51) Int. Cl.

| | |
|---|---|
| ***B26F 1/12*** | (2006.01) |
| ***B43L 23/08*** | (2006.01) |
| ***B26D 7/01*** | (2006.01) |
| ***B43K 19/00*** | (2006.01) |
| ***B43L 23/00*** | (2006.01) |

(52) U.S. Cl.

CPC ..... *B26F 1/12* (2013.01); *B26D 7/01* (2013.01); *B43K 19/00* (2013.01); *B43L 23/00* (2013.01); *B43L 23/08* (2013.01); *B26D 2007/013* (2013.01)

(58) Field of Classification Search

CPC ..... B26D 2007/013; B26D 7/01; B26F 1/12
See application file for complete search history.

(56) References Cited

U.S. PATENT DOCUMENTS

| | | | | | |
|---|---|---|---|---|---|
| 1,351,086 | A | | 8/1920 | Wright | |
| 2,964,984 | A | * | 12/1960 | Schott | B21D 28/14 83/694 |
| 4,872,384 | A | * | 10/1989 | Borzym | B23D 21/00 83/454 |
| 5,964,137 | A | * | 10/1999 | Jung | B23D 21/02 83/54 |
| 9,744,581 | B2 | * | 8/2017 | Bullard | B21D 28/34 |

OTHER PUBLICATIONS

Log Cabins Craft, Log Cabins, crayola.com, Apr. 21, 2016, 2 pages. http://www.crayola.com/crafts/log-cabins-craft/.

Crayola Crayon Log Cabin, VivaBoo, Apr. 2, 2013, 2 pages. http://www.vivaboo.com/crayola-crayon-log-cabin/.

Cruzzle—Crayon puzzle, it's a crayon and an interlocking puzzle. www.imprintitems.com, Apr. 21, 2016, 2 pages. http://www.imprintitems.com/custom/11672559.

* cited by examiner

*Primary Examiner* — Andrea L Wellington
*Assistant Examiner* — Fernando A Ayala
(74) *Attorney, Agent, or Firm* — Shook Hardy & Bacon, LLP

(57) ABSTRACT

Devices, kits, and methods for manipulating crayons to make various crayon configurations are provided. Embodiments of the invention include a crayon slicer, a crayon shaver, a crayon holder, a crayon notcher, a crayon shaving kit, and a crayon rubbing kit. The multiple embodiments of the invention have various features that allow for a crayon to be easily and safely manipulated by a user in multiple ways. Further, additional embodiments provide additional features, which allow the user to make various crayon configurations.

19 Claims, 14 Drawing Sheets

CRAYON MANIPULATION DEVICES

CROSS REFERENCE TO RELATED APPLICATION

This application claims priority to U.S. Provisional Application No. 62/347,974 entitled "CRAYON MANIPULATION DEVICES," filed Jun. 9, 2016, the entire contents of which is hereby incorporated by reference.

SUMMARY

Embodiments of the invention are defined by the claims below, not this summary. This high-level overview of various aspects of the invention provides an overview of the disclosure and introduces a selection of concepts that are further described in the detailed description section below. This summary is not intended to identify key features or essential features of the claimed subject matter, and is not intended to be used as an aid in isolation to determine the scope of the claimed subject matter.

In brief and at a high level, this disclosure describes, among other things, devices and kits for manipulating crayons to make various crayon configurations. Embodiments of the invention include a crayon slicer, a crayon shaver, a crayon holder, a crayon notcher, a crayon shaving kit, and a crayon rubbing kit. The crayon slicer has a handgrip, a base platform and a slicer. During use, the crayon slicer makes a cut on a crayon that causes the crayon to break at the cut. The crayon slicer can be used to cut multiple crayons into individual segments of variable length. The crayon shaver has a cap and a receptacle, which are removably coupled. The cap houses a shaver and when in use, the cap receives a crayon and upon the twisting of the crayon by a user, crayon shavings are created as result of the crayon's contact with the shaver. Further, the crayon shaver can accompany wax paper, stencils, and canvas boards to provide for the crayon shaving kit. The crayon holder has a handle and a receiver and when in use, the crayon holder fixes a crayon in a lengthwise position with the underside of the crayon exposed, allowing a user to rub the underside of the crayon on a given surface. The crayon holder with a textured plate provides for the crayon rubbing kit. Lastly, the crayon notcher has a base notcher assembly and a top notcher assembly and during use, the crayon notcher can be used to create relatively uniform notches in a crayon.

DESCRIPTION OF THE DRAWINGS

Illustrative embodiments of the invention are described in detail below with reference to the attached drawing figures, and wherein.

DETAILED DESCRIPTION

Figure 1:
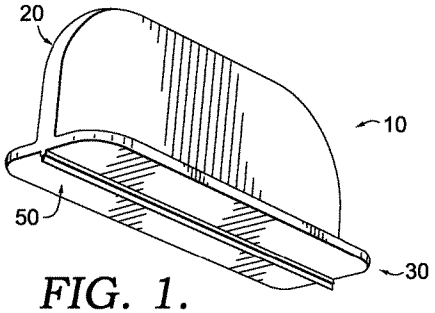
FIG. 1 is a front perspective view of a crayon slicer, in accordance with an embodiment of the invention.

The subject matter of embodiments of the invention is described with specificity herein to meet statutory requirements. The description itself is not intended to necessarily limit the scope of claims. Rather, the claimed subject matter might be embodied in other ways to include different steps or combinations of steps similar to the ones described in this document, in conjunction with other present or future technologies. Terms should not be interpreted as implying any particular order among or between various steps herein disclosed unless and except when the order of individual steps is explicitly described.

Embodiments of the invention are directed to devices and kits for manipulating crayons. An embodiment of the invention includes a crayon slicer that makes a cut along the surface of a crayon. The cut is of sufficient depth and length to cause the crayon to break near the cut. The crayon slicer has a first end and a second end and includes a handgrip, a base platform, and a slicer, all of which extend between the first end and the second end. The base platform has a top surface and a bottom surface with the handle coupled to the top surface and the slicer coupled to the bottom surface. Thus, the handgrip and the slicer are positioned on opposite sides of the base platform and are vertically aligned along a y-axis. During use, the slicer and the bottom surface of the base platform are engaged with the crayon at single points of contact. As the crayon slicer is moved forward, the crayon is rolled between the crayon slicer and a surface causing the points of contact between the slicer and the crayon and between the bottom surface and the crayon to extend along the crayon. As a result, the slicer makes a circumferential cut into the crayon along the points of contact between the slicer and the crayon.

One embodiment of the invention includes a crayon shaver having a removably coupled cap and receptacle. The cap has a chamber that extends vertically therethrough and is capable of receiving a crayon. Further, the cap houses a shaver, which extends into the circumference of the chamber. The shaver is capable of producing crayon shavings upon contacting a crayon that is twisted by a user. The resulting crayon shavings are collected by the receptacle. In a further embodiment, a crayon shaving kit is provided, which includes the crayon shaver, wax paper, stencils, and canvas boards.

Another embodiment of the invention includes a crayon holder having a handle and a receiver. The receiver is capable of holding a crayon in a length-wise, fixed positioned contacting only the top side of the crayon's surface, thereby leaving the underside of the crayon's surface exposed. In a further embodiment of the invention, the crayon rubbing kit is provided, which includes the crayon holder and a textured plate.

In some embodiments, the receiver may be configured to secure either a regular crayon size or a larger (i.e., "jumbo") crayon size. Similarly, the slicer of the crayon slicer may be increased in size to make a deeper cut into a larger crayon, and the cap and the shaver of the crayon shaver may be increased in size to receive and shave a larger crayon.

An additional embodiment of the invention includes a crayon notcher having a base notcher assembly and a top notcher assembly that are coupled to each other at the corners. The base notcher assembly is positioned below the top notcher assembly and includes a crayon compartment, four spring connectors, and pairs of front, middle, and back notcher channels. The top notcher assembly includes a front opening, four cylindrical connectors, and pairs of front, middle, and back notchers. The four cylindrical connectors are coupled to the four spring connectors and the pairs of front, middle, and back notchers are vertically aligned with the pairs of front, middle, and back notcher channels. In operation, a wrapped or unwrapped crayon is placed into the crayon compartment. Then, a user pushes down on the top of the crayon notcher causing the pairs of front, middle, and back notchers to pass through the pairs of front, middle, and back notcher channels and contact the crayon. The crayon notcher is configured such that, the front, middle, and back notchers contact the crayon in such a way that relatively six uniform notches are created in the crayon. Upon the user releasing pressure from the top of the crayon notcher, the four spring connectors return the crayon notcher to a first upward resting position and the notched crayon may be removed from the crayon compartment.

As with other embodiments of the crayon manipulation devices, the crayon notcher may be configured to function with either a regular crayon size or a larger (i.e., "jumbo") crayon size. The components of the crayon notcher may be increased in size to receive and make deeper notches into a larger crayon.

With reference now to the figures, crayon manipulation devices and kits are described in accordance with embodiments of the invention. Various embodiments are described with respect to the figures in which like elements are depicted with like reference numerals.

With reference initially to FIGS. 1-3*a*, an embodiment of a crayon manipulation device, a crayon slicer 10, is shown with various features for making cuts into crayons to create crayon segments of varying lengths. In FIG. 1, the crayon slicer 10 includes a handgrip 20, a base platform 30, and a slicer 50. The base platform 30 has a top surface 32 and a bottom surface 34. The handgrip 20 projects vertically upward from the base platform 30 along the top surface 32. The slicer 50 projects vertically downward from the base platform 30 along the bottom surface 34. Thus, the base platform 30 is horizontally situated between the handgrip 20 and the slicer 50 with the handgrip 20 and the slicer 50 projecting perpendicularly to the base platform 30 from opposite sides. In some embodiments, the crayon slicer 10 is comprised of the same material throughout and may be a rigid material such as a plastic. The crayon slicer 10 may be of any material such that the slicer 50 is capable of cutting through a crayon wrapper and into a crayon.

Figure 2:
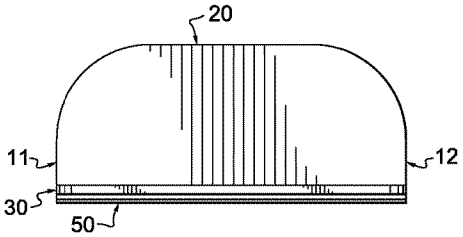
FIG. 2 is a side view of the crayon slicer of FIG. 1, in accordance with an embodiment of the invention.
Figure 3B:
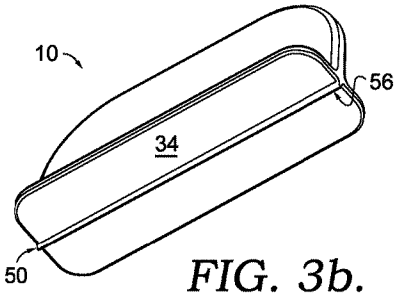
FIG. 3*b* is a bottom perspective view of a crayon slicer, in accordance with an embodiment of the invention.
Figure 3A:
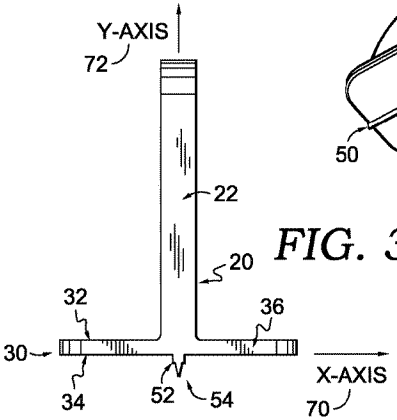
FIG. 3*a* is a front view of the crayon slicer of FIG. 1, in accordance with an embodiment of the invention.

As shown in FIGS. 2 and 3*a*, the crayon slicer 10 has a first end 11 and a second end 12. The handgrip 20, the base platform 30, and the slicer 50 extend between the first and seconds ends 11, 12 with the handgrip 20 and the slicer 50 being continually coupled to the base platform 30. The base platform 30 is horizontally planar and presents a minimal vertical edge 36 between the top surface 32 and the bottom surface 34 that extends along the perimeter the base platform 30. The base platform 30 is configured to be substantially planar so that the vertical edge 36 has a minimal surface area in comparison to those of the top surface 32 and the bottom surface 34.

Referring to FIGS. 1-3*a*, the base platform 30 is rectangular in shape with the two longer sides extending parallel to the handgrip 20 and the slicer 50 between the first and second ends 11, 12 and with the two shorter sides extending perpendicularly to the handgrip 20 and the slicer 50 at the front and second ends 11, 12. The base platform 30 can be configured to be rounded at the points of convergence between each rectangular side along the vertical edge 36 to improve the safety of the crayon slicer 10. Further, the base platform 30 is configured to be of sufficient width to allow for portions of the bottom surface 34 to be contiguous with the cylindrical surface of a crayon during use of the crayon slicer 10. Further, during use, the contact between the bottom surface 34 and the cylindrical surface of a crayon may vertically stabilize the crayon slicer 10 and aid in the rolling of the crayon. In a further aspect, the base platform 30 separates the handgrip 20 from the slicer 50 and during normal use, prevents the user from contacting the slicer 50.

As shown in FIGS. 2 and 3*a*, the handgrip 20 is substantially planar, thereby presenting a minimal outer edge 22 along the outermost surface of the handgrip 20. In one embodiment, the handgrip 20 can be substantially rectangular in shape with the two shorter sides extending vertically upward from the base platform 30 at the first and second ends 11, 12 and with the two longer sides extending between the first and second ends 11, 12. Further, the handgrip 20 can be configured to be rounded at the points of convergence between the rectangular sides along the outer edge 22 to improve the safety of the crayon slicer 10. In another embodiment, the handgrip 20 can be arcuate in shape, projecting from the base platform 30 in a manner to form an arch-like shape between the first and second ends 11, 12. The handgrip 20 may be configured of any height and shape sufficient to allow a user to comfortably grip the crayon slicer 10 during use.

As shown in FIG. 3*a*, the base platform 30 is flatly positioned on a horizontal plane overlaying an x-axis 70 and the handgrip 20 and the slicer 50 are positioned along a vertical plane overlaying a y-axis 72, thereby being vertically aligned. Further, the handgrip 20 and the slicer 50 vertically project from the center, relative to the x-axis 70, of the base platform 30. Thus, the base platform 30 is perpendicular to the handgrip 20 and the slicer 50 and forms a T shaped junction with both the handgrip 20 and the slicer 50.

As further shown in FIGS. 1 and 3*a*, the slicer 50 comprises a first step 52 and a second step 54. The first step 52 is squarely shaped forming a cuboid as it extends between the first and second ends 11, 12. The first step 52 terminates at a flat surface that is parallel to the x-axis 70, thereby forming a squared edge on the bottom side of the first step 52. The second step 54 is fixed to the bottom side of the first step 52 and extends downwardly from the center, relative to the x-axis, of the first step 52. The surface of the second step 54 that is adjacent to the first step 52 is of smaller width than the first step 52, thereby presenting a ledge. The second step 54 is triangular in shape and forms a triangular prism as it extends between the first and second ends 11, 12. Thus, the second step 54 forms a point as it terminates away from the first step 52. The point formed at the termination of the second step 54 is configured to cut paper, such as a crayon wrapper and to penetrate the outer surface of a crayon during use. The slicer 50 is sized to create a cut of sufficient depth and length along a crayon surface that would cause the crayon to break at the cut.

In another embodiment, shown in FIG. 3*b*, the slicer 50 comprises a single triangular blade 56 and forms a triangular prism as it extends between the first and second ends 11, 12. The base of the triangular blade 56 is adjacent to the bottom surface 34. As the triangular blade 56 terminates away from the bottom surface 34, a point is formed. The point is configured to cut paper, such as a crayon wrapper and to penetrate the outer surface of a crayon during use. The triangular blade 56 is sized to create a cut of sufficient depth and length along a crayon surface that would cause the crayon to break at the cut. In further embodiments, the slicer 50 may be of any shape capable of creating a cut of sufficient depth and length along a crayon surface causing the crayon to break.

Figure 4A:
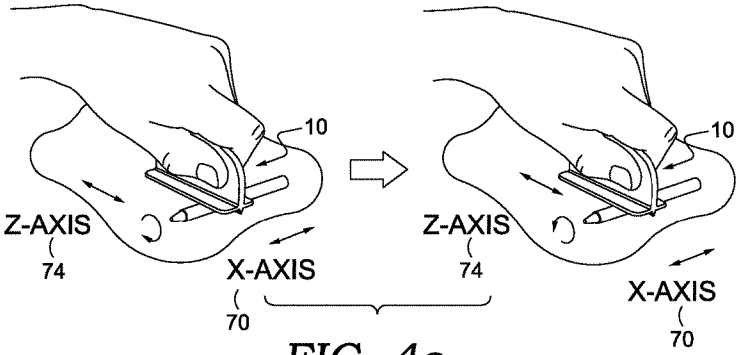
FIG. 4*a* is a perspective view of the crayon slicer of FIG. 1 in use, in accordance with an embodiment of the invention.

Referring to FIG. 4*a*, an embodiment of the crayon slicer 10 is shown during use. Generally, the user grips the crayon slicer 10 at the handgrip 20, presses the crayon slicer 10 onto a crayon thereby engaging the slicer 50 with the surface of the crayon, and moves the crayon slicer 10 forward. In use, the crayon slicer 10 is positioned perpendicular to the crayon with the crayon slicer 10 being aligned with a z-axis 74 and with the crayon being aligned with the x-axis 70. This position allows for the slicer 50 to engage the cylindrical surface of the crayon, thereby creating a circumferential cut along the crayon during use. The crayon slicer 10 engages the cylindrical crayon surface with the slicer 50 near the first end 11. Sufficient pressure is applied through the handgrip 20 towards the crayon to cause the slicer 50 to cut through a crayon wrapper and penetrate the crayon surface. The slicer 50 extends into the crayon at a depth sufficient to allow the at least a portion of the bottom surface 34 to contact the crayon surface. The crayon slicer 10 is then moved along the z-axis 74 while sufficient pressure is continuously applied to the handgrip 20 to maintain the penetration depth of the slicer 50 into the crayon and to further maintain the contact between the bottom surface 34 and the crayon surface. Upon forward movement of the crayon slicer 10 along the z-axis 74, the crayon simultaneously rotates in a clockwise direction around the x-axis 70. Upon backward movement of the crayon slicer 10 along the z-axis 74, the crayon simultaneously rotates in a counter-clockwise direction around the x-axis 70. Further, the movement of the crayon slicer 10 along the z-axis 74 circumferentially extends the slicer 50 into the crayon thereby producing a circumferential cut. The length of the circumferential cut in the crayon corresponds to the distance between the movement of the crayon slicer 10 along the z-axis from a first position and a second position.

Figure 4B:
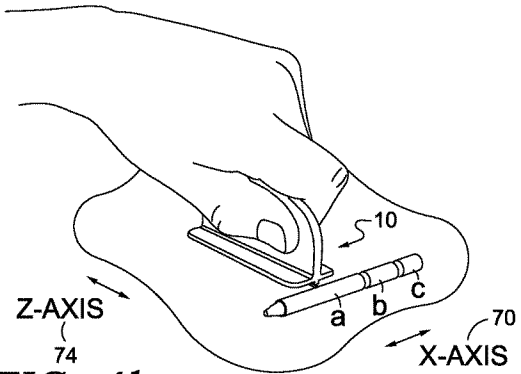
FIG. 4*b* is a perspective view the crayon slicer of FIG. 1 before use, in accordance with an embodiment of the invention.
Figure 4C:
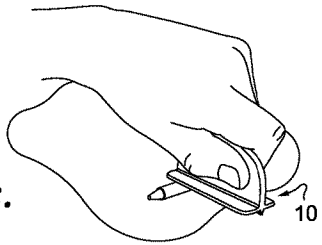
FIG. 4*c* is a perspective view the crayon slicer of FIG. 1 after use, in accordance with an embodiment of the invention.

In further aspects, the crayon slicer 10 is configured to make a cut of sufficient length and depth into a crayon to break the crayon near the cut. In some embodiments, the crayon slicer 10 can be configured for use with crayons of differing sizes. For larger crayons, the slicer 50 can be increased in size to create a deeper cut into the crayon. In a further aspect, as shown in FIGS. 4*b* and 4*c*, prior to use, the crayon slicer 10 can be placed at any point along the cylindrical surface of a crayon body in order to create multiple crayon segments of varying size. As shown in FIG. 4*b*, crayon segments a, b, and c of differing sizes can be created by the crayon slicer 10. Further, the crayon slicer 10 is capable of being used with a wrapped or unwrapped crayon. The slicer 50 as shown in both FIGS. 3*a* and 3*b* or any other slicer capable of cutting a crayon, may be included during use of the crayon slicer 50 as shown in FIGS. 4*a*, 4*b*, and 4*c*.

Figure 5A:
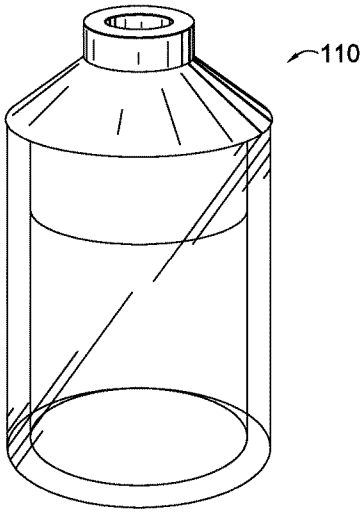
FIG. 5*a* is a front perspective view of a crayon shaver, in accordance with an embodiment of the invention.
Figure 6:
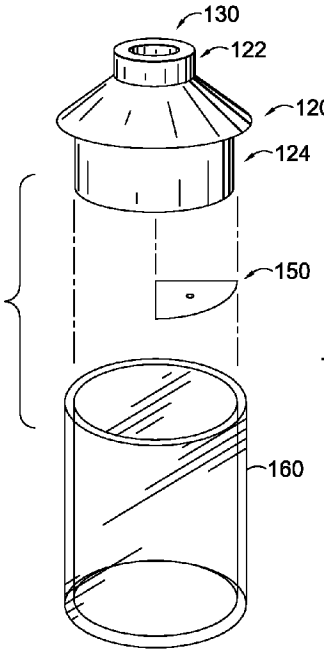
FIG. 6 is an exploded view of the crayon shaver of FIG. 5, in accordance with an embodiment of the invention.

Another embodiment of a crayon manipulation device, a crayon shaver 110, is shown in FIGS. 5*a* and 6. The crayon shaver 110 has a cap 120, a shaver 150 and a receptacle 160. The cap 120 comprises a top 122, a bottom 124, and a chamber 130 and also internally houses the shaver 150. Further, the cap 120 and the receptacle 160 are removably coupled with the bottom 124 being contiguous with the receptacle 160. The chamber 130 extends between the top 122 and the bottom 124 along a vertical axis 134, thereby presenting passageway through the cap 120. The chamber 130 is cylindrical in shape and is configured to receive a crayon of a specified size; the size of the chamber 130 can be manufactured accordingly.

In some embodiments, the cap 120 may be circular in shape at the bottom 124 and then taper toward a point at the top 122. As such, the cap 120 may have a conical shape. Further, the cap 120 may be a rigid material such that the cap 120 is capable of firmly holding the shaver 150 in place during use.

Further, the receptacle 160 is generally hollow and capable of receiving and collecting crayon shavings. In some embodiments, the receptacle 160 may be cylindrical in shape and maybe be a rigid material such that the receptacle 160 is capable of being removably coupled with the bottom 124. In a further aspect, the receptacle 160 may be a transparent material to allow a user to observe collected crayon shavings.

Figure 7B:
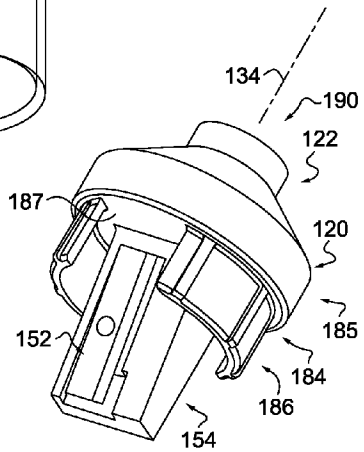
FIG. 7*b* is a bottom perspective view of a cap of the crayon shaver of FIG. 5*b*, in accordance with an embodiment of the invention.
Figure 7A:
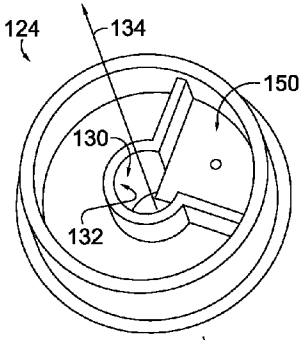
FIG. 7*a* is a bottom perspective view of a cap of the crayon shaver of FIG. 5*a*, in accordance with an embodiment of the invention.

FIG. 7*a* shows the bottom 124 of the cap 120 and the internal housing of the shaver 150 of the crayon shaver 110 in FIGS. 5*a* and 6. The chamber 130 includes an inner surface 132, is aligned with a vertical axis 134, and is interrupted by the shaver 150 near the bottom 124 of the cap 120. The inner surface 132 is circumferential about the chamber 130 and is radially centered about the vertical axis 134. The shaver 150 is fixed within the cap 120 and is inaccessible to the user during use of the device. Near the bottom 124, the shaver 150 intersects a portion of the circumference of the inner surface 132 and extends into the chamber 130. The shaver 150 can intersect the circumference of the inner surface 132 angularly to the vertical axis 134. Further, the shaver 150 can be pie-shaped with the point of the shaver extending towards the vertical axis 134. The shaver 150 extends into the chamber 130 at a distance sufficient to contact a crayon as it is passed through the chamber 130. The shaver 150 may be a metal such that the shaver 150 maintains a sharp edge capable of cutting a crayon.

Figure 5B:
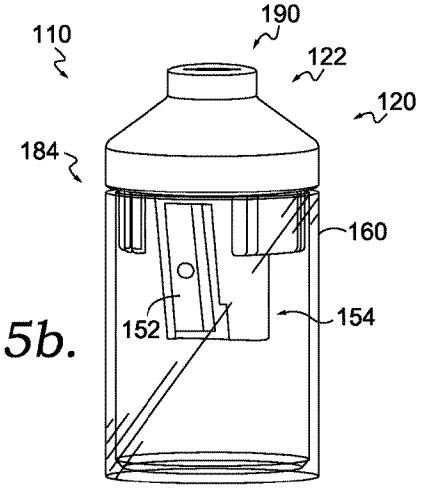
FIG. 5*b* is a front perspective view of a crayon shaver, in accordance with an embodiment of the invention.

FIGS. 5*b* and 7*b* show an additional embodiment of the crayon shaver 110. In this embodiment, the cap 120 of the crayon shaver 110 comprises an exposed bottom 184, a partial chamber 190, and a shaver housing 154. The partial chamber 190 extends from the top 122 through the cap 120 and converges into the shaver housing 154 located towards the exposed bottom 184. Further, the partial chamber 190 is aligned with the vertical axis 134, is cylindrical in shape, and is configured to receive a crayon of a specified size; the size of the partial chamber 190 can be manufactured accordingly to receive crayons of regular size or larger (i.e., "jumbo") size.

Continuing with FIGS. 5*b* and 7*b*, the exposed bottom 184 has an upper portion 185 and a lower portion 186. The upper portion 185 is adjacent to the top 122 and has an internal surface 187. The lower portion 186 extends downwardly from the internal surface 187. When the cap 120 is coupled with the receptacle 160, the upper portion 185 may form a flush edge with the outside of the receptacle 160, the internal surface 187 may contact the upper most portion of the receptacle 160, and the lower portion 186 may be contiguous with the inside of the receptacle 160. In another aspect, the lower portion 186 is complimentary to the shape and size of the receptacle 160 and therefore, is configured to couple the cap 120 with the receptacle 160.

As further shown in FIGS. 5*b* and 7*b*, the shaver housing 154 is coupled with the exposed bottom 184 and is within the receptacle 160 when the cap 120 is coupled thereto. The shaver housing 154 extends angularly downward from the internal surface 187 and is in communication with the partial chamber 190, such that the shaver housing 154 is configured to receive a crayon from the partial chamber 190. Further the shaver housing 154 has a housed shaver 152 and is configured to angularly present the housed shaver 152 to a crayon received from the partial chamber 190 during use. Further, the housed shaver 152 may be a metal such that the housed shaver 152 maintains a sharp edge capable of cutting a crayon.

Figure 8:
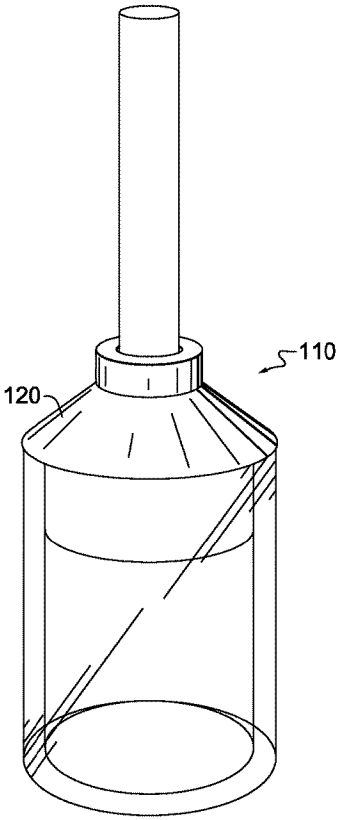
FIG. 8 is a perspective view of the crayon shaver of FIG. 5 in receipt of a crayon, in accordance with an embodiment of the invention.
Figure 9:
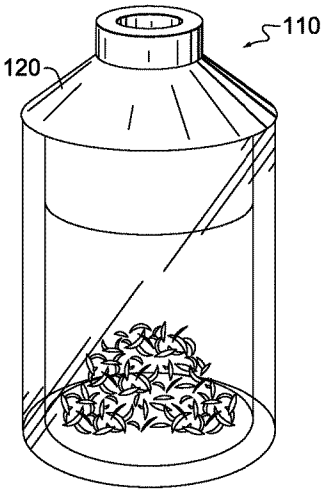
FIG. 9 is a perspective view the crayon shaver of FIG. 5 after use, in accordance with an embodiment of the invention.

In FIG. 8 the crayon shaver 110 is first shown with the chamber 130 in receipt of a crayon prior to use, and in FIG. 9, the crayon shaver 110 is shown after use with crayon shavings in the receptacle 160. Either of the tops 120 shown in FIGS. 7*a* and 7*b* may be used in FIGS. 8 and 9. As shown, the inner surface 132 compliments the surface of a crayon and is configured to guide the crayon through the chamber 130 during. Further, the inner surface 132 is configured to contain the crayon within the chamber 130 while also allowing the crayon to be rotated about the vertical axis 134. In use, the chamber 130 receives a crayon, and within the chamber 130, the tip of the crayon contacts the shaver 150. The user presses the crayon towards the receptacle 160 and simultaneously rotates the crayon. The shaver 150 then engages the crayon, thereby shaving the crayon as it passes through the chamber 130. In further aspects, the shaver 150 may extend into the chamber 130 at a distance such that the tip of the shaver 150 meets with the center of the crayon during use, thereby shaving the entire crayon upon contact with the shaver 150. The resulting crayon shavings are collected by the receptacle 160. The cap 120 and the receptacle 160 can then be uncoupled, allowing the user to access the crayon shavings. In addition, the embodiment shown in FIGS. 5*a* and 7*a* is configured to function and operate as disclosed in this paragraph.

In other embodiments, the crayon shaver 110 can be configured for use with crayons of differing sizes. The chamber 130, the inner surface 132, and the shaver 150 may be sized to correspond with a particular crayon size. Additionally, the partial chamber 190, the housed shaver housing 154 and housed shaver 152 may also be sized to correspond with a particular crayon size. Therefore, the crayon shaver 110 may be manufactured in multiple sizes that correspond to a particular crayon size, thereby allowing the crayon shaver 110 to be used with a crayon of any size.

Figure 10A:
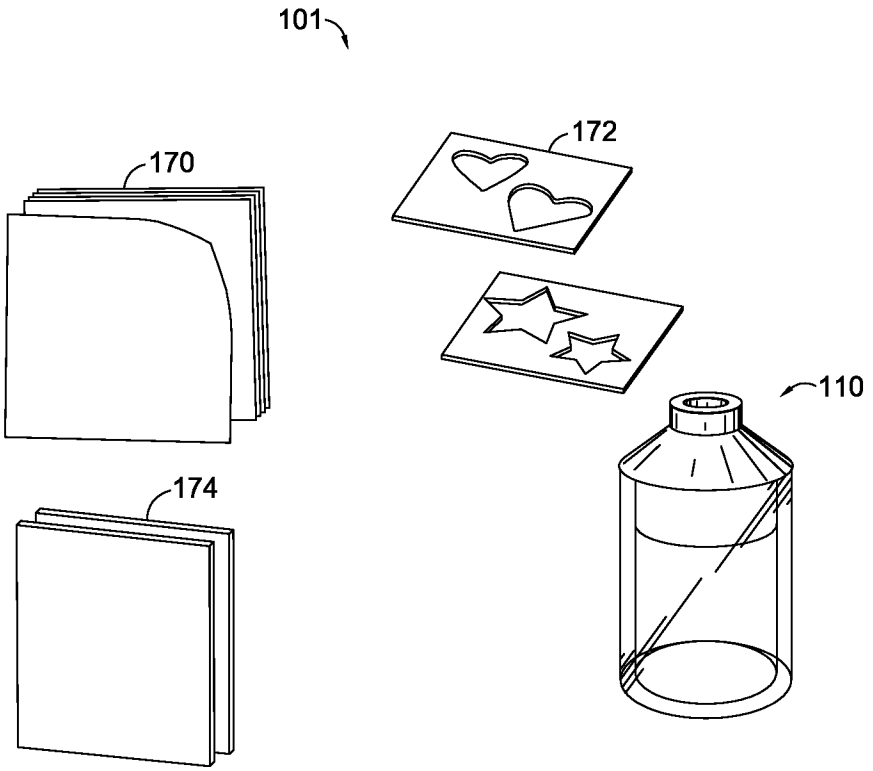
FIG. 10*a* is a perspective view of a crayon shaving kit, in accordance with an embodiment of the invention.
Figure 10B:
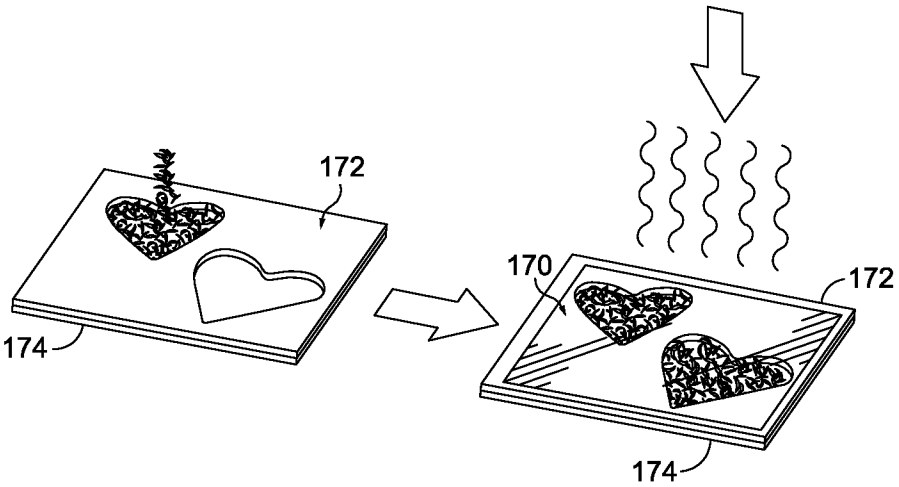
FIG. 10*b* is a perspective view of the crayon shaving kit of FIG. 10 during use, in accordance with an embodiment of the invention.

FIGS. 10*a* and 10*b* show an embodiment of a crayon manipulation kit, a crayon shaving kit 101. The crayon shaving kit 101 includes the crayon shaver 110, wax paper 170, a stencil 172, and a canvas board 174. In embodiments, the stencil 172 has a cutout and is of sufficient thickness to contain crayon shavings within the cutout when placed atop a give surface. In use, the stencil 172 is placed atop the canvas board 174, and crayon shavings provided by the crayon shaver 110 are dispersed into the cutout of the stencil 172. After dispersing the crayon shavings, the wax paper 170 is placed atop the stencil 172 and a heat source is provided to the wax paper 170 on the opposing side.

Figure 11:
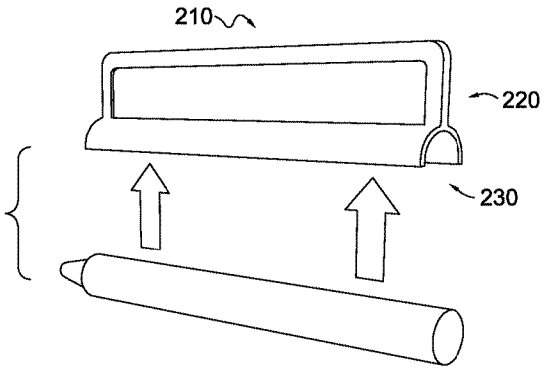
FIG. 11 is a front perspective view of a crayon holder, in accordance with an embodiment of the invention.

Turning now to FIG. 11, a further embodiment is shown as a crayon holder 210. The crayon holder 210 includes a handle 220 and a receiver 230. The handle 220 and the receiver 230 can be the same length, which can also be similar to the length of a crayon body or may be of a greater length than a crayon body. The handle 220 is positioned above the receiver 230, and the handle 220 and the receiver 230 are continuously coupled along the bottom side of the handle 220 and along the top side of the receiver 230. The handle 220 can be rectangular in shape and is vertically planar. The top corners of the handle 220 can be rounded to improve the safety of the crayon holder 210. The receiver 230 is configured to hold a crayon in a lengthwise manner while leaving a portion of the crayon's surface exposed. Thus, the receiver 230 can be the shape of a half circle, forming a hollow half cylinder. In some embodiments, the crayon holder 210 is comprised of the same material throughout and may be a rigid material such as a plastic. The material is such that the receiver 230 is capable of flexing out of shape to receive and release a crayon before and after use, and is capable of returning to shape to firmly secure a crayon during use.

Figure 12A:
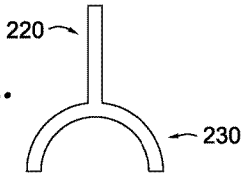
FIG. 12*a* is a front view of the crayon holder of FIG. 11, in accordance with an embodiment of the invention.
Figure 13:
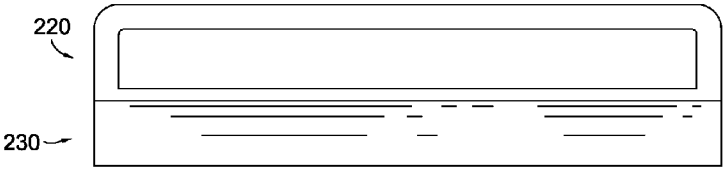
FIG. 13 is a side view of the crayon holder of FIG. 11, in accordance with an embodiment of the invention.
Figure 14:
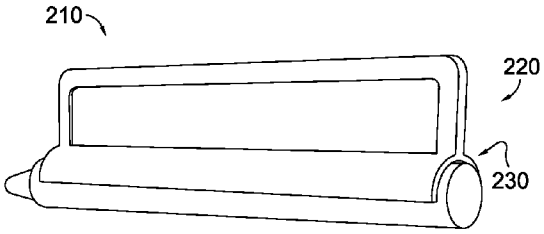
FIG. 14 is a perspective view of the crayon holder of FIG. 11 in receipt of a crayon, in accordance with an embodiment of the invention.

FIGS. 12*a*, 13, and 14 show the crayon holder 210 of FIG. 11 from the front, the side, and while holding a crayon. As shown, the crayon holder 210 can be symmetrical along a vertically longitudinal plane and a vertically lateral plane. The handle 220 is substantially vertical and is coupled to the center of the receiver 230 at the top side. The receiver 230 extends downwardly from the handle 220 in a curved manner and can form a half circle. Thus, when the receiver 230 engages a crayon, the receiver 230 only contacts the upper portions of the crayon surface, thereby allowing the lower crayon surface opposite the receiver 230 to contact a given surface. Further, the receiver 230 is configured to firmly secure a crayon and to also allow the crayon to be easily removed. The receiver 230 is configured to receive a crayon of a specified size, and the crayon holder 210 can be manufactured accordingly. Thus, in other embodiments, the receiver 230 of the crayon holder 210 may be sized differently for use with crayons of different sizes.

Figure 12B:
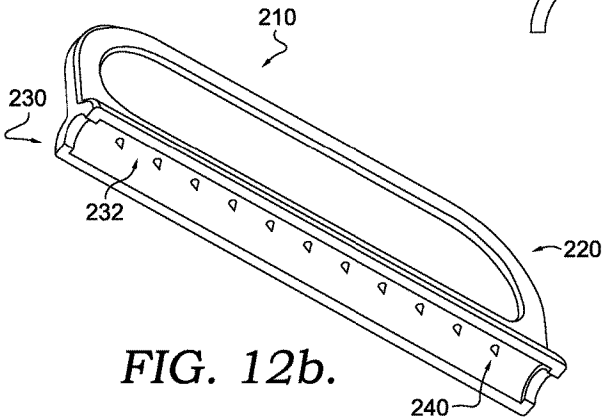
FIG. 12*b* is a bottom perspective view of a crayon holder, in accordance with an embodiment of the invention.

In an alternative embodiment, as shown in FIG. 12*b*, the receiver 230 has a curved inner surface 232 that lines the interior of the receiver 230 and a plurality of conical fasteners 240, which includes multiple conically-shaped fasteners with bases being adjacent to the curved inner surface 232 and points being formed as the conical fasteners 240 extend away from the curved inner surface 232. The conical fasteners 240 are each cone-shaped and may be in lengthwise alignment along the curved inner surface 232 such that the plurality of conical fasteners 240 are vertically aligned with the handle 220. Moreover, the plurality of conical fasteners 240 is configured to penetrate the surface of a crayon to better secure the crayon within the receiver 230 during use. In other embodiments, any gripping mechanism can be used to hold the crayon within the receiver 230, such as a snap-fit mechanism or a lock fit mechanism.

FIG. 14 shows the crayon holder 210 in use and also shows an alternative embodiment, a crayon rubbing kit 201. In use, the crayon holder 210 secures a crayon within the receiver 230. The user grips the crayon holder 210 at the handle 220, and then presses the crayon holder 210 toward a given surface so that the exposed crayon surface contacts the given surface.

Figure 15:
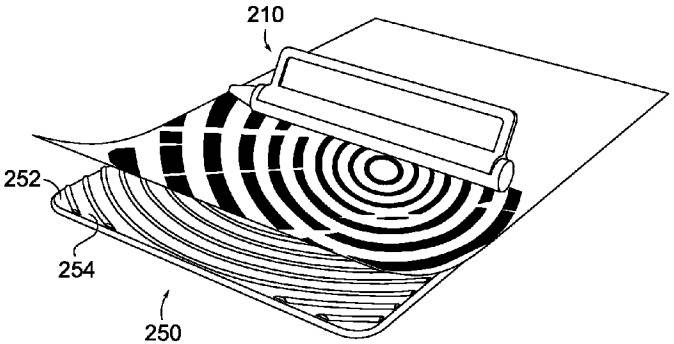
FIG. 15 is a perspective view of the crayon holder of FIG. 11 during use and a crayon rubbing kit in use, in accordance with an embodiment of the invention.

Referring to FIG. 15, the crayon rubbing kit 201 includes the crayon holder 210 and a textured plate 250. The textured plate 250 can be planar and has a raised surface 252 and a recessed surface 254 with the raised surface 252 positioned at a higher first level and the recessed surface 254 positioned at a lower second level. The higher first level and the lower second level are positioned along parallel planes. The raised and recessed surfaces 252, 254 are configured to create various designs or patterns from voids formed as a result of the differing heights of the raised and recessed surfaces 252, 254. In use, the textured plate 250 is placed under a medium, such as paper. The crayon holder 210 with a crayon secured by the receiver 230 is then guided by the handle 220 toward the textured plate 250 causing the exposed crayon surface to contact the medium overlaying the textured plate 250. The crayon holder 210 can be moved about the medium as the user chooses to cause the exposed crayon surface to contact the medium at multiple locations.

Figure 16A:
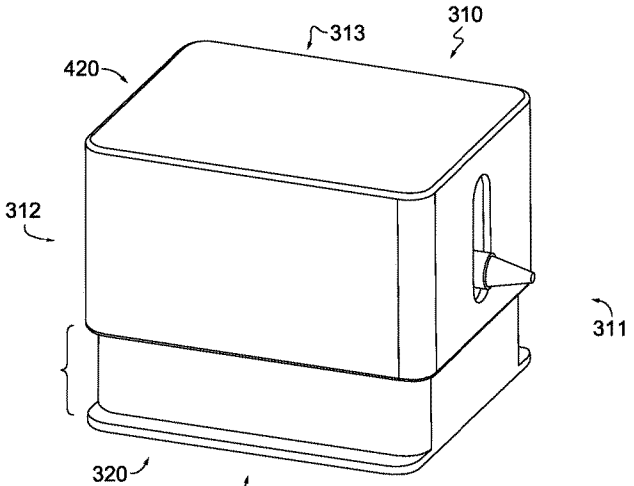
FIG. 16*a* is a side perspective view of a crayon notcher prior to engagement with a crayon in an upward position, in accordance with an embodiment of the invention.
Figure 16B:
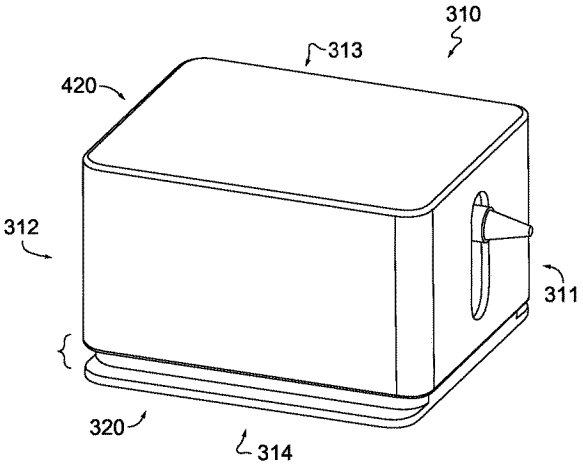
FIG. 16*b* is a side perspective view of a crayon notcher engaged with a crayon in a downward position, in accordance with an embodiment of the invention.

Moving to FIGS. 16*a* and 16*b*, an additional embodiment of a crayon manipulation device, a crayon notcher 310, is shown. The crayon notcher 310 has a front 311, a back 312, a top 313, and a bottom 314. Further, the crayon notcher 310 includes a base notcher assembly 320 and a top notcher assembly 420. The base notcher assembly 320 is positioned below and is mostly covered by the top notcher assembly 420. The front, back, top, and bottom 311, 312, 313, 314 are relatively rectangular in shape and the crayon notcher 310 may be in the shape of a cuboid. In other embodiments, the crayon notcher 310 may be of other shapes such as a cube or may be a combination of different shapes. FIG. 16*a* shows the crayon notcher 310 in an upward position, prior to engaging a crayon, and FIG. 16*b* shows the crayon notcher 310 in a downward position, during engagement with the crayon. As shown, a greater amount of the base notcher assembly 320 is shown in FIG. 16*a* than in FIG. 16*b*. Thus, the top notcher assembly 420 travels a threshold distance when pressed from the top 313 that is sufficient to create a notch in a crayon.

In some embodiments, the crayon notcher may include a top having an arcuate in shape that is maintained as the top extends between a front and a back having a shape of half-circles. Moreover, the crayon notcher may include a bottom that is rectangular, and therefore, the crayon notcher may be in the shape of a half-cylinder or other cylindroid shape.

Figure 17:
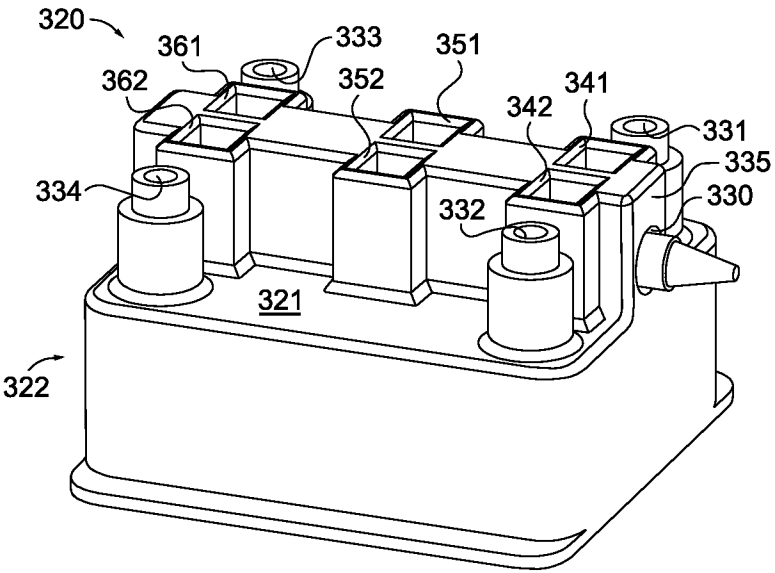
FIG. 17 is a side perspective view of a base notcher assembly of the crayon notcher of FIGS. 16*a* and 16*b*, in accordance with an embodiment of the invention.

FIG. 17 shows the base notcher assembly 320 of the crayon notcher 310 in FIG. 16. The base notcher assembly 320 includes a base notcher surface 321; a base 322; a crayon opening 330; a crayon compartment 335; a first, second, third, and fourth spring connector 331, 332, 332, 334; a first and a second front notcher channel 341, 342; a first and a second middle notcher channel 351, 352; and a first and a second back notcher channel 361, 362. The base notcher surface 321 is on top of the base 322 and the crayon opening 330 is positioned adjacent to the front 311. The crayon opening 330 presents the crayon compartment 335 that extends lengthwise or in a horizontal direction through the base notcher assembly 320 from the front 311 to the back 312. Further, the crayon compartment 335 is configured to receive a crayon such that the crayon is relatively secured in place but may also be easily removed from the crayon compartment 335. In other embodiments, the crayon compartment 335 may be sized to receive crayons of differing sizes.

Continuing with FIG. 17, the first, second, third, and fourth spring connectors 331, 332, 332, 334 extend perpendicularly from the base notcher surface 321 and are positioned at the corners of and above the base 322. Internally, the first, second, third, and fourth spring connectors 331, 332, 332, 334 may house a spring, and thus may extend into the base 322 and may be cylindrical in shape or complimentary to that of a spring. At the top of the first, second, third, and fourth spring connectors 331, 332, 332, 334, proximate to the top 313, there is an opening configured to allow for coupling of the base notcher assembly 320 to the top notcher assembly 420. In other embodiments, the first, second, third, and fourth spring connector 331, 332, 332, 334 can be of any shape and located any points along the base 322.

As further shown in FIG. 17, pairs of first and second notcher channels at the front, middle, and back 341, 342, 351, 352, 361, 362 extend perpendicularly from the base notcher surface 321, with the first and second front notcher channels 341, 342 proximate to the front 311, the first and second back notcher channels 361, 362, proximate to the back 312, and the first and second middle notcher channels 351, 352 between front 311 and back 312. Proximate to the top 313, the notcher channels 341, 342, 351, 352, 361, 362 contain openings and on the opposite end, may extend downward into a portion of the crayon compartment 335

Figure 19:
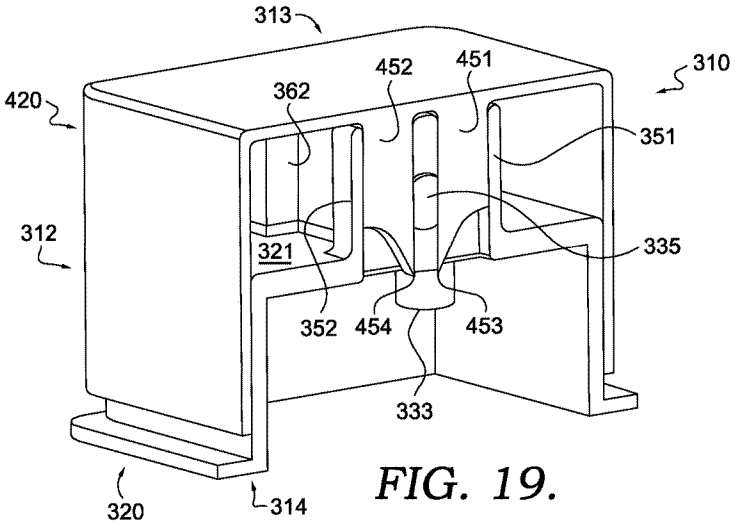
FIG. 19 is a cross-sectional view of the crayon notcher of FIGS. 16*a* and 16*b*, in accordance with an embodiment of the invention.

(shown in FIG. 19). In other embodiments, there may be any number of notcher channels 341, 342, 351, 352, 361, 362, which may be located anywhere along the base notcher surface 321.

Figure 18:
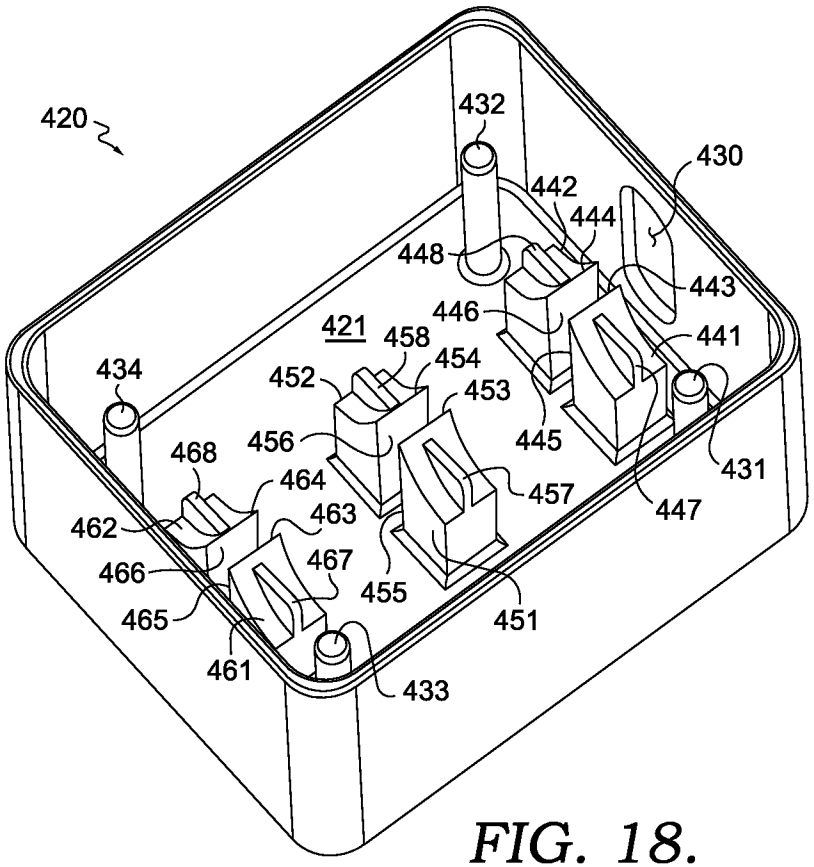
FIG. 18 is a bottom perspective view of a top notcher assembly of the crayon notcher, in accordance with an embodiment of the invention.

Referring to FIG. 18, the top notcher assembly 420 is shown. The top notcher assembly 420 includes a top notcher surface 421; a front opening 430; a first, second, third, and fourth cylindrical connector 431, 432, 433, 434; a first and a second front notcher 441, 442; a first and a second middle notcher 451, 452; a first and a second back notcher 461, 462. The notchers 441, 442, 451, 452, 461, 462 each have a blade 443, 444, 453, 454, 463, 464; an inner surface 445, 446, 455, 456, 465, 466; and a rib 447, 448, 457, 458, 467, 468. The cylindrical connectors 431, 432, 433, 434 and the notchers 441, 442, 451, 452, 461, 462 may be located at numerous points along the top notcher surface 421 and are not limited to those shown in FIG. 18.

Figure 20:
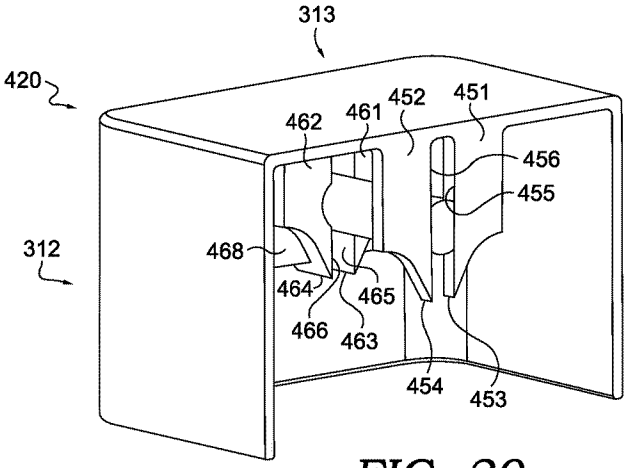
FIG. 20 is a cross-sectional view of the top notcher assembly of the crayon notcher of FIGS. 16*a* and 16*b*, in accordance with an embodiment of the invention.

Turning now to FIG. 19, a cross-sectional view of the crayon notcher 310 in 16*b* is shown. Generally, the front opening 430 is horizontally aligned with the crayon opening 330 and crayon compartment 335 and each are configured to allow movement of the top notcher assembly 420 as shown in FIGS. 16*a* and 16*b*. Moreover, the cylindrical connectors 431, 432, 433, 434 are in vertical alignment with the spring connectors 331, 332, 332, 334. Similarly, the notchers 441, 442, 451, 452, 461, 462 are in vertical alignment with the notcher channels 341, 342, 351, 352, 361, 362, and the notchers 441, 442, 451, 452, 461, 462 enter and extend through crayon compartment 335 during use. Thus, the blades 443, 444, 453, 454, 463, 464 initially contact the crayon surface during use and penetrate the crayon causing the inner surfaces 445, 446, 455, 456, 465, 466 to be contiguous with the crayon. The blades 443, 444, 453, 454, 463, 464 are configured to be capable of cutting into a crayon. Further, the ribs 447, 448, 457, 458, 467, 468 push the excess crayon material into the base 322 during use. Engagement of the top notcher assembly with a crayon during use is further shown in FIG. 20.

Figure 21:
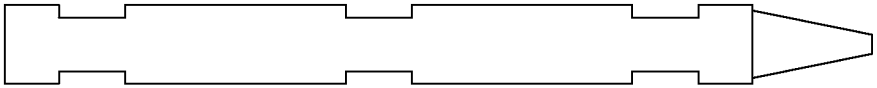
FIG. 21 is a front perspective view of a crayon with notches from the crayon notcher of FIGS. 16*a* and 16*b*, in accordance with an embodiment of the invention.
Figure 22:
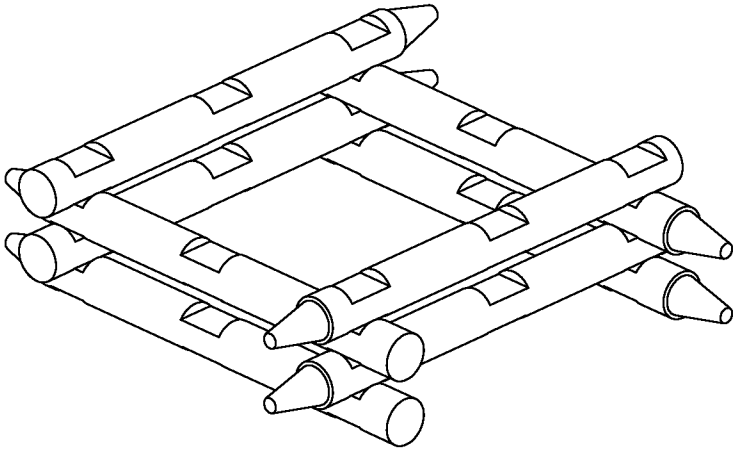
FIG. 22 is a front perspective view of crayons with notches from the crayon notcher of FIGS. 16*a* and 16*b*, in accordance with an embodiment of the invention.

FIGS. 21 and 22 show crayon(s) with notches from the crayon notcher 310 shown in FIGS. 16*a* and 16*b*. In other embodiments, any number or combination of the notcher channels 341, 342, 351, 352, 361, 362 and the notchers 441, 442, 451, 452, 461, 462 may be included in the crayon notcher 310, and therefore, are capable of creating any number or combination of notches in a crayon. Thus, the notches created within the crayons are not limited to those shown in FIGS. 21 and 22. Further, any number or combination of the cylindrical connectors 431, 432, 433, 434 and the spring connectors 331, 332, 332, 334 may be implanted into the crayon notcher 310.

In use, a wrapped or unwrapped crayon is first placed through the front opening 430 and the crayon opening 330 and into the crayon compartment 335. The crayon is pushed fully into the crayon compartment 335 until it reaches the end of the crayon compartment proximate to the back 312. The user then pushes down on the top 313, causing the notchers 441, 442, 451, 452, 461, 462 to contact the crayon body in such a way that the blades 443, 444, 453, 454, 463, 464 and inner surfaces 445, 446, 455, 456, 465, 466 create uniform notches in the crayon. As the blades 443, 444, 453, 454, 463, 464 cut into and through the crayon, the ribs 447, 448, 457, 458, 467, 468 on the back side of the notchers 441, 442, 451, 452, 461, 462 push the excess crayon material into the base 322. The user releases pressure on the top 313, the internal springs of the spring connectors 331, 332, 332, 334 then help to push the crayon notcher 310 to the upward position. The user can then remove the notched crayon from the crayon compartment 335.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A crayon notching mechanism comprising:

a base notcher assembly having at least one spring connector, at least one base notcher channel, and a crayon compartment, the crayon compartment configured to receive a crayon body; and a top notcher assembly corresponding to the base notcher assembly, said top notcher assembly comprising at least one cylindrical connector and at least one notcher, the at least one notcher having a blade, an inner arcuate surface having a vertical portion and a horizontal portion, and a rib, wherein the rib comprises at least a first surface protruding from the vertical portion and a second surface protruding from the horizontal portion, such that the first surface is positioned perpendicular to the second surface;

wherein the base notcher assembly and top notcher assembly are configured to couple based on the at least one spring connector and the at least one cylindrical connector, wherein the crayon notching mechanism is moveable between an upward position and a downward position and the top notcher assembly travels a threshold distance between the upward position and the downward position such that the at least one notcher contacts at least a portion of the crayon body, wherein the threshold distance is sufficient to create a notch in the crayon body.

2. The crayon notching mechanism of claim 1, further comprising a front, a back, a top, and a bottom that collectively form a shape of the crayon notching mechanism.

3. The crayon notching mechanism of claim 2, wherein the crayon compartment extends in a horizontal direction through the base notcher between the front and the back of the crayon notching mechanism.

4. The crayon notching mechanism of claim 2, wherein the at least one base notcher channel comprises an opening positioned proximate the top of the crayon notching mechanism and configured for receiving the at least one notcher, and wherein the at least one base notcher channel extends in a vertical direction away from the opening toward the bottom of the crayon notching mechanism and intersects with a portion of the crayon compartment.

5. The crayon notching mechanism of claim 4, wherein the at least one notcher extends into the base notcher channel, and wherein, at the upward position, the blade of the at least one notcher is positioned above the crayon compartment and at the downward position, the blade of the at least one notcher is positioned below the crayon compartment.

6. The crayon notching mechanism of claim 5, wherein, upon movement from the upward position to the downward position, the at least one crayon notcher is configured to create one or more notches in the crayon body received by the crayon compartment.

7. The crayon notching mechanism of claim 6, wherein the base notcher assembly comprises one or more front base notcher channels proximate the front of the crayon notching mechanism, one or more back base notcher channels proximate the back of the crayon notching mechanism, and one or more middle base notcher channels positioned between the one or more front base notcher channels and the one or more back base notcher channels.

8. The crayon notching mechanism of claim 7, wherein the top notcher assembly comprises one or more front notchers proximate the front of the crayon notching mechanism, one or more back notchers proximate the back of the crayon notching mechanism, and one or more middle notchers positioned between the one or more front notcher channels and the one or more back notcher channels.

9. The crayon notching mechanism of claim 8, wherein, upon movement from the upward position to the downward position, the one or more front, middle, and back notchers are each configured to make a corresponding notch in the crayon body received by the crayon compartment.

10. A crayon notching mechanism comprising:

a base notcher assembly having at least one spring connector, at least one base notcher channel, a base, and a crayon compartment, the crayon compartment configured to receive a crayon body; and a top notcher assembly corresponding to the base notcher assembly, said top notcher assembly comprising at least one cylindrical connector and at least one notcher, the at least one notcher having a blade, an inner surface, and a rib, wherein the rib comprises at least a first surface protruding from a vertical portion of the inner surface, and a second surface protruding from a horizontal portion of the inner surface, such that the first surface is positioned perpendicular to the second surface;

wherein the base notcher assembly and top notcher assembly are configured to couple based on the at least one spring connector and the at least one cylindrical connector, wherein the crayon notching mechanism is moveable between an upward position and a downward position and the top notcher assembly travels a threshold distance between the upward position and the downward position such that the at least one notcher contacts at least a portion of the crayon body, wherein the threshold distance is sufficient to create a notch in the crayon body.

11. The crayon notching mechanism of claim 10, further comprising a front, a back, a top, and a bottom that collectively form a shape of the crayon notching mechanism.

12. The crayon notching mechanism of claim 11, wherein at least a portion of the crayon notching mechanism is a shape selected from the following:

a) a cube;
b) a cuboid;
c) a half-cylinder; or
d) a cylindroid.

13. The crayon notching mechanism of claim 11, wherein the base notcher assembly comprises a first spring connector, a second spring connector, a third spring connector, and a fourth spring connector.

14. The crayon notching mechanism of claim 13, wherein the first and second spring connectors are positioned proximate the front of the crayon notching mechanism, and wherein the third and fourth spring connectors are positioned proximate the back of the crayon notching mechanism.

15. The crayon notching mechanism of claim 13, wherein the base notcher assembly further comprises a base notcher surface presented on an upper side of the base, and wherein the first, second, third, and fourth spring connectors extend perpendicularly from the base notcher surface.

16. The crayon notching mechanism of claim 15, wherein each of the first second, third, and fourth spring connectors are positioned above the base and proximate a different corner of the base.

17. The crayon notching mechanism of claim 11, wherein the top notcher assembly comprises a first cylindrical connector, a second cylindrical connector, a third cylindrical connector, and a fourth cylindrical connector, and wherein each of the first, second, third, and fourth cylindrical connectors are in vertical alignment with one of the first, second, third, or fourth spring connectors of the base notcher assembly.

18. The crayon notching mechanism of claim 11, wherein the at least one base notcher channel comprises an opening positioned proximate the top of the crayon notching mechanism and configured for receiving the at least one notcher, and wherein the at least one base notcher channel extends in a vertical direction away from the opening, toward the bottom of the crayon notching mechanism, and intersects with a portion of the crayon compartment.

19. The crayon notching mechanism of claim 18, wherein the at least one notcher extends into the base notcher channel, and wherein, at the upward position, the blade of the at least one notcher is positioned above the crayon compartment and at the downward position, the blade of the at least one notcher is positioned below the crayon compartment.

* * * * *